US005636744A

United States Patent [19]

Hirose

[11] Patent Number: 5,636,744

[45] Date of Patent: Jun. 10, 1997

[54] CUSHIONING MATERIAL FOR PACKING

[75] Inventor: Takashi Hirose, Tokyo, Japan

[73] Assignee: NEC Corporation, Japan

[21] Appl. No.: 571,675

[22] Filed: Dec. 13, 1995

[30] Foreign Application Priority Data

Dec. 15, 1994 [JP] Japan ..... 6-311600

[51] Int. Cl.[6] ..... B65D 81/02

[52] U.S. Cl. ..... 206/586; 206/592; 428/34.2

[58] Field of Search ..... 206/521, 583, 206/586, 591–594; 428/34.1–34.3, 172

[56] References Cited

FOREIGN PATENT DOCUMENTS

| | | | |
|---|---|---|---|
| 4025257 | 2/1992 | Germany | 206/594 |
| 5-170264 | 7/1993 | Japan | 206/586 |
| 5-230269 | 9/1993 | Japan . | |
| 6-72460 | 3/1994 | Japan | 206/523 |

*Primary Examiner*—Jimmy G. Foster

*Attorney, Agent, or Firm*—Ostrolenk, Faber, Gerb & Soffen, LLP

[57] ABSTRACT

A cushioning material for packing includes a cushioning member body, a large number of spherical members, and an adhesive. The cushioning member body uses one of a pulp material and paper as a raw material and is formed into a box-like shape. The large number of spherical members are formed using one of a pulp material and paper as a raw material and are filled in the cushioning member body. The adhesive adheres the spherical members to each other and the spherical members to the cushioning member body to fix the spherical members in the cushioning member body.

10 Claims, 2 Drawing Sheets

CUSHIONING MATERIAL FOR PACKING

BACKGROUND OF THE INVENTION

The present invention relates to a cushioning material for packing and, more particularly, to a cushioning material for packing, which is used to prevent damage to an article in, e.g., transporting the article.

A conventional cushioning material for packing, which can be burned, uses a cushioning member manufactured by a pulp molding method or adhesion of paper. The cushioning member is obtained by the pulp molding method such that a pulp material is sprayed to a mold having a predetermined shape to form a surface member made of the pulp material.

Another example is disclosed as a cushioning material (Japanese Patent Laid-Open No. 5-230269) in which pulp beads containing a reclaimed pulp as the main raw material are filled in a frame and foamed to have a shape conforming to the shape of the frame.

The physical strength cannot be assured by only the cushioning member manufactured by the pulp molding method because the thickness of the cushioning material itself is small. Even if an implementation such as formation of ribs is provided, it is difficult to apply this cushioning material as a cushioning material for packing a heavy article. To obtain a predetermined strength, the molding shape must be complicated.

In the cushioning material in which the beads consisting of a pulp material are foamed, the process is complicated, and a decrease in manufacturing cost is difficult. In addition, a large amount of material is required to result in high material cost. A large amount of waste is produced in discarding the cushioning material.

SUMMARY OF THE INVENTION

It is an object of the present invention to provide a cushioning material for packing having a sufficiently high strength for a heavy article to be packed.

It is another object of the present invention to provide a cushioning material for packing, which can be manufactured at low cost and burned.

In order to achieve the above objects of the present invention, there is provided a cushioning material for packing, comprising a cushioning member body using one of a pulp material and paper as a raw material and formed into a box-like shape, a large number of spherical members formed using one of a pulp material and paper as a raw material and filled in the cushioning member body, and an adhesive for adhering the spherical members to each other and the spherical members to the cushioning member body to fix the spherical members in the cushioning member body.

DESCRIPTION OF THE PREFERRED EMBODIMENT

Figure 1:
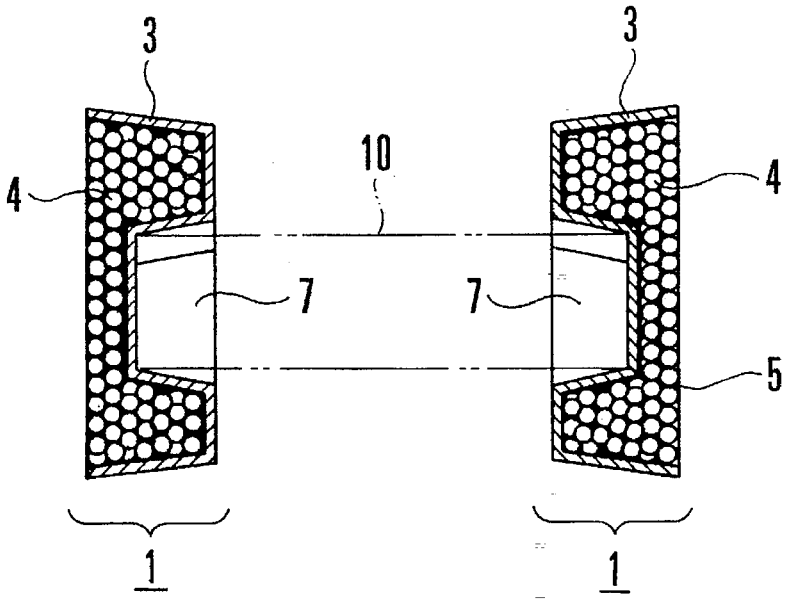
FIG. 1 is a sectional view of a cushioning material according to an embodiment of the present invention.
Figure 2:
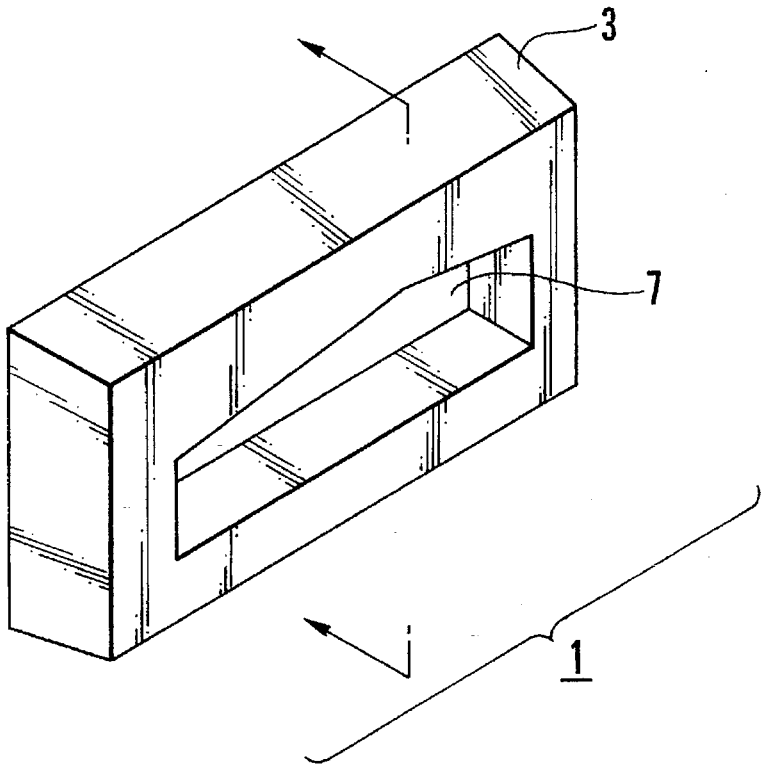
FIG. 2 is a perspective view of the cushioning material shown in FIG. 1.

An embodiment of the present invention will be described with reference to FIGS. 1 to 5. This embodiment shows an application in which two ends of an article to be packed are held and supported by two cushioning materials. Reference numerals 1 denote cushioning materials; 3, cushioning member bodies serving as frames; and 4, spherical members.

Referring to FIG. 1, each cushioning member body 3 is formed in a box-like shape by a pulp molding method and has a central recess 7 in its one surface (inner surface) so as to support one of the two end portions of a thick plate-like article 10 to be packed. At this time, the other surface (outer surface) of the cushioning member body 3 is open to receive spherical members 4 (to be described later) therein. The four side surfaces and the inner wall surrounding the recess 7 of the cushioning member body 3 are formed as predetermined inclined surfaces. The cushioning member body 3 may be formed not by the pulp molding method but by adhesion of paper.

A large number of hollow spherical members 4 made of a pulp material are filled in each cushioning member body 3. To increase the strength of the cushioning member body 3, the spherical members 4 are adhered and fixed to each other with an adhesive 5. The adhesive 5 consists of a biologically decomposable material. Examples of the adhesive 5 are a natural polysaccharide (e.g., sodium alginate, starch, agar, or mannan), a treated natural polysaccharide (e.g., carboxymethyl cellulose), and a synthesized aqueous polymer (e.g., polyvinyl alcohol).

All the spherical members 4 will not be coated with the adhesive 5. Only the spherical members 4 located on the surface of the opening are coated with the adhesive 5 to fix these spherical members 4 to each other and to the cushioning member body 3. The plurality of spherical members 4 located inside the adhered and fixed spherical members 4 can be relatively deformed, so that the load can be distributed in the entire cushioning material 1. In the same reason as described above, the coating amount of the adhesive 5 for the spherical members 4 is adjusted to arbitrarily set the strength of each cushioning material 3.

The size of each spherical member 4 can be set in accordance with a required strength. In addition, spherical members 4 having different sizes may be appropriately mixed depending on the shape of a cushioning member body 3 to which the spherical members are to be filled. This method is effective to adjust the strength of the cushioning material 1.

Figure 3:
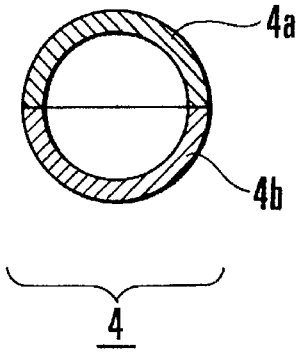
FIG. 3 is a sectional view of a spherical member shown in FIG. 1.
Figure 4:
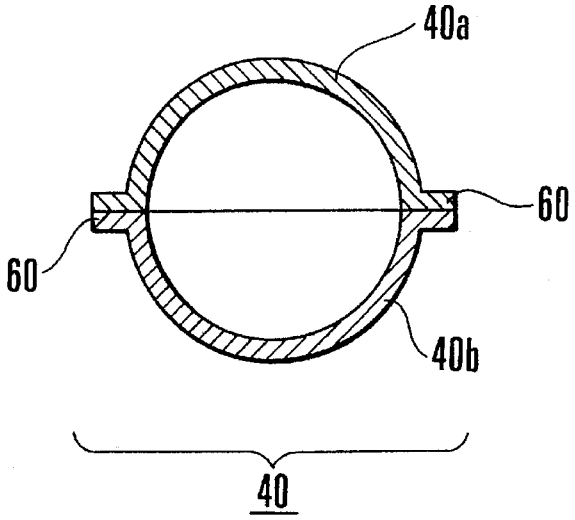
FIG. 4 is a sectional view showing another spherical member.

FIGS. 3 and 4 show different spherical members 4 to be filled in the cushioning member bodies 3. The spherical member 4 is constituted by two semispherical members **4*a* and 4*b* each formed by adhesion of paper or the pulp molding method. The two semispherical members 4*a* and 4*b* are adhered to each other with an adhesive to constitute the spherical member 4. As shown in FIG. 4, when the adhesion area of a spherical member 40 is small with respect to the diameter of the spherical member 40, edge portions 60 may be formed at the adhesion portions of semispherical members 40** to increase the adhesion area, thereby assuring the adhesion between the semispherical members.

Figure 5:
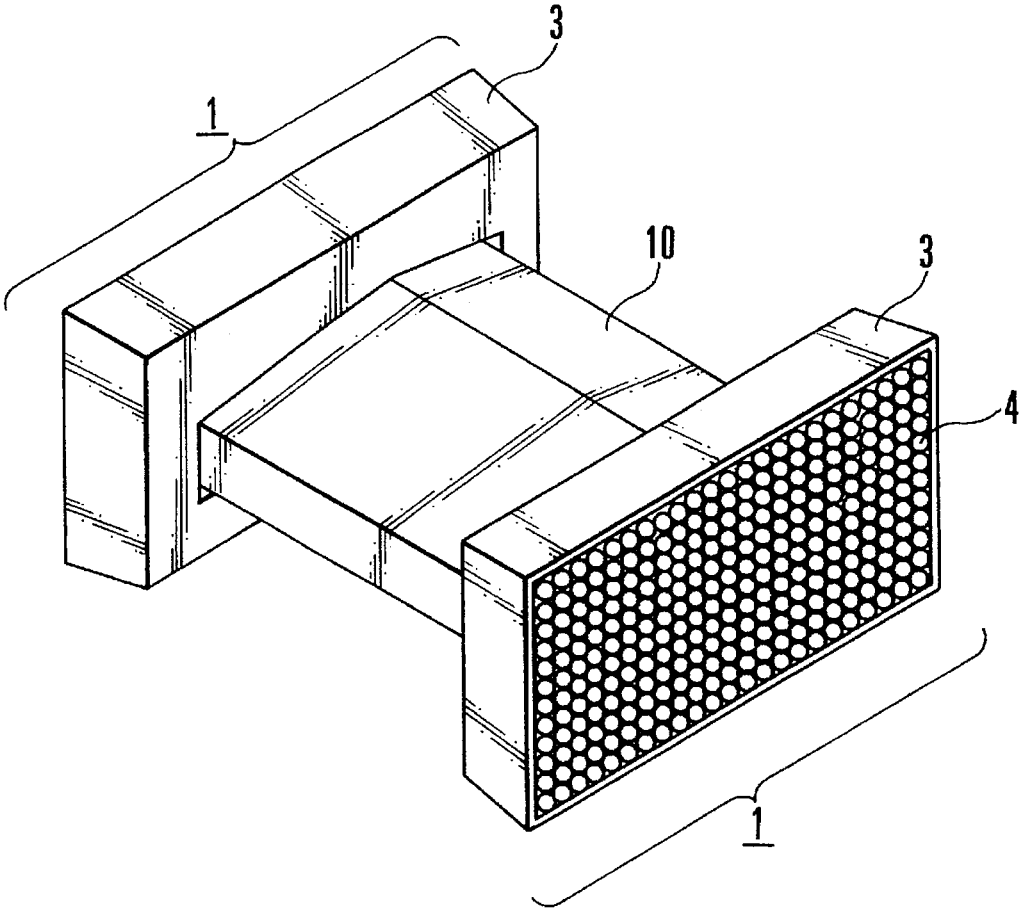
FIG. 5 is a perspective view showing a state in which the cushioning material is applied to an article to be packed.

An application in which this embodiment is applied to an article 10 to be packed will be described with reference to FIG. 5.

The pair of cushioning materials 1 have almost the same shape and are located at two end portions of the article 10. The end portions of the article 10 are inserted into and supported by the central recesses 7 formed in the inner surfaces of the respective cushioning materials 1. The article supported by the cushioning materials 1 are normally packaged in a box (not shown) such as a card-board box, and the resultant package is transported.

In this case, the cushioning materials 1 have predetermined elasticity, so the vibrations and impacts during transportation can be absorbed, thereby preventing damage to the article 10.

According to the present invention, spherical members are filled in a cushioning member body formed by adhesion of paper or the pulp molding method and are fixed with an adhesive. As compared with a cushioning material formed of only the cushioning member body, the strength can be greatly increased, thereby providing a cushioning material having an excellent effect which has not been achieved in the conventional structure.

Since the strength can be increased by the spherical members filled in the cushioning member body, the cushioning member body need not be molded into a complicated shape to increase the strength. Cushioning materials having predetermined strengths can be provided relatively freely for articles having various shapes. This effect has not been achieved in the conventional structure.

Since the spherical members are formed as hollow members by adhesion of paper or pulp molding and are fixed with an adhesive, a lightweight cushioning member having a predetermined strength can be formed, and at the same time the coating amount of the adhesive is adjusted to arbitrary adjust the strength of the cushioning material, resulting in an advantageous effect.

When the size of spherical members filled in the cushioning member body is appropriately set to adjust the strength of the cushioning material. This cushioning material can easily cope with wide, heavy articles.

As compared with the case using a foamed member disclosed as the conventional example, large equipment such as a heating means need not be used, thereby providing a high-performance cushioning material at low cost. This effect has not been obtained in the conventional structure.

In addition, since the cushioning material is entirely made of a pulp as a major raw material, it can be easily burned without causing waste pollution. The cushioning material can also be used as a landfill material without causing waste pollution because it is biologically decomposable.

What is claimed is:

1. A cushioning material for packing, comprising:

a cushioning member body formed of a pulp material;

a plurality of spherical members formed of one of a pulp material and paper, said plurality of spherical members filling said cushioning member body, each of said spherical members being hollow; and an adhesive for adhering said spherical members to each other and for adhering said spherical members to said cushioning member body to fix said spherical members in said cushioning member body.

2. A cushioning material according to claim 1, wherein said cushioning member body has a recess formed in an inner surface thereof to conform to a shape of an end of an article to be packed.

3. A cushioning material according to claim 1, wherein said spherical member is constituted by two semispherical members adhered to each other at adhesion surfaces thereof.

4. A cushioning material according to claim 3, wherein each of said semispherical members has edge portions for increasing an adhesion area of the adhesion surfaces.

5. A cushioning material according to claim 1, wherein said cushioning member body has an opening to receive said spherical members filling said cushioning member body, and said adhesive adheres said spherical members located at the opening portion of said cushioning member body and said spherical members located at an edge portion of the opening portion of said cushioning member body to said cushioning member body.

6. A cushioning material according to claim 5, wherein said cushioning member body has a recess formed in an inner surface thereof to conform to a shape of an end of an article to be packed.

7. A cushioning material according to claim 1, wherein said adhesive on said spherical members forms a coating thereon, and said cushioning material having a strength being determined by the amount of said coating.

8. A cushioning material according to claim 1, wherein said cushioning material has a strength determined by size of said spherical members.

9. A cushioning material according to claim 1, wherein said cushioning material has a strength determined by a predetermined number of said spherical members having different sizes.

10. A cushioning material for packing, comprising:

a cushioning member body formed of a pulp material;

a plurality of spherical members formed of one of a pulp material and paper, said plurality of spherical members filling said cushioning member body, each of said spherical members being hollow; and an adhesive for adhering said spherical members to each other and for adhering said spherical members to said cushioning member body to fix said spherical members in said cushioning member body;

said cushioning member body having an opening to receive said spherical members in said cushioning member body, and said adhesive adheres said spherical members located at the opening of said cushioning member body and said spherical members located at an edge portion of the opening of said cushioning member body to said cushioning member body.

* * * * *